United States Patent [19]

Schilling

[11] 4,445,605

[45] May 1, 1984

[54] SPRING ENGAGED FLUID RELEASED FAN CLUTCH FOR A LIVE SHAFT

[75] Inventor: Hugh K. Schilling, St. Paul, Minn.

[73] Assignee: Horton Industries, Inc., Minneapolis, Minn.

[21] Appl. No.: 426,591

[22] Filed: Sep. 29, 1982

Related U.S. Application Data

[63] Continuation of Ser. No. 180,846, Aug. 25, 1980, Pat. No. 4,355,710.

[51] Int. Cl.[3] ..... F16D 13/44; F16D 25/063

[52] U.S. Cl. ..... 192/91 A; 192/82 T; 192/85 A

[58] Field of Search ..... 192/91 A, 82 T, 85 A, 192/85 AA; 188/170

[56] References Cited

U.S. PATENT DOCUMENTS

| | | | |
|---|---|---|---|
| 1,300,898 | 4/1919 | Vincent | 192/66 X |
| 2,543,252 | 2/1951 | Nabstedt et al. | 188/170 X |
| 2,575,765 | 11/1951 | Nabstedt et al. | 192/55 X |
| 2,637,308 | 5/1953 | Dodge | 123/41.08 |
| 2,684,742 | 7/1954 | Eason | 192/91 A |
| 2,698,676 | 1/1955 | Eason | 192/91 A X |
| 2,865,481 | 12/1958 | De Teramala | 192/52 X |
| 2,877,751 | 3/1959 | Johnston | 123/41.123 |
| 2,927,563 | 3/1960 | Geiger | 123/41.12 |
| 3,016,121 | 1/1962 | Mosbacher | 192/85 AA X |
| 3,145,816 | 8/1964 | De Lorean et al. | 192/91 A |
| 3,270,588 | 9/1966 | Bowen et al. | 192/91 A X |
| 3,500,970 | 3/1970 | Schilling | 188/170 |
| 3,568,647 | 3/1971 | Adams | 123/41.12 |
| 3,684,397 | 8/1972 | Elmer | 192/70.15 X |
| 3,915,433 | 10/1975 | Therkildsen | 192/91 A X |
| 3,943,893 | 3/1976 | Tsubaki et al. | 123/41.12 |
| 4,057,297 | 11/1977 | Beck et al. | 188/170 X |
| 4,081,066 | 3/1978 | Ryba | 192/82 T |
| 4,132,301 | 1/1979 | Zabonick | 192/85 AA |
| 4,184,573 | 1/1980 | Bricker et al. | 188/170 |
| 4,238,017 | 12/1980 | Spokas | 192/91 A X |
| 4,245,724 | 1/1981 | Beck | 188/170 |
| 4,355,710 | 10/1982 | Schilling | 192/91 A |

FOREIGN PATENT DOCUMENTS

| | | |
|---|---|---|
| 229910 | 10/1959 | Australia . |
| 230716 | 10/1959 | Australia . |
| 293130 | 10/1966 | Australia . |
| 445518 | 2/1974 | Australia . |
| 2815474 | 10/1979 | Fed. Rep. of Germany . |
| 2017610 | 5/1970 | France . |
| 2433102 | 3/1980 | France . |

*Primary Examiner*—Rodney H. Bonck
*Attorney, Agent, or Firm*—Wicks & Nemer

[57] ABSTRACT

A spring engaged fluid released fan clutch is disclosed. A sheave connected to a live shaft is connected to rotate with a friction disc. Encompassing the friction disc and rotatable relative thereto is an outer shell portion carrying fan blades. Connected for rotation with the outer shell portion and rotatably mounted on the friction disc is a cylinder plate. An annular piston, having a friction facing, is slidably mounted on a hub provided internally of the outer shell portion and is connected to rotate with the shell portion. Springs urge the piston with its friction facing into engagement with the friction disc to engage the clutch. Fluid pressure is introduced through the hub of said outer shell portion and into a cavity between the cylinder plate and the piston urging the piston away from the friction disc against the action of the springs to disengage the clutch.

14 Claims, 3 Drawing Figures

SPRING ENGAGED FLUID RELEASED FAN CLUTCH FOR A LIVE SHAFT

This application is a continuation of application Ser. No. 06/180,846, filed Aug. 25, 1980 and now U.S. Pat. No. 4,355,710.

SUMMARY

The invention relates to an improvement in clutches and more particularly to a spring engaged fluid released fan clutch for a live shaft.

It is an object of the invention to provide a spring engaged fluid released fan clutch with which the fan load is substantially centered over a support bearing, and the clutch is mounted on a live shaft as compared to a conventional mounting on a stationary shaft. It is a further object to provide a clutch having construction which provides structural integrity by means of an encompassing totally enclosed outer shell as opposed to a conventional thru-the-center hub/shaft arrangement.

In the drawings forming part of this application:

FIG. 1 is an end view of a spring engaged fluid released fan clutch embodying the invention.

Figure 2:
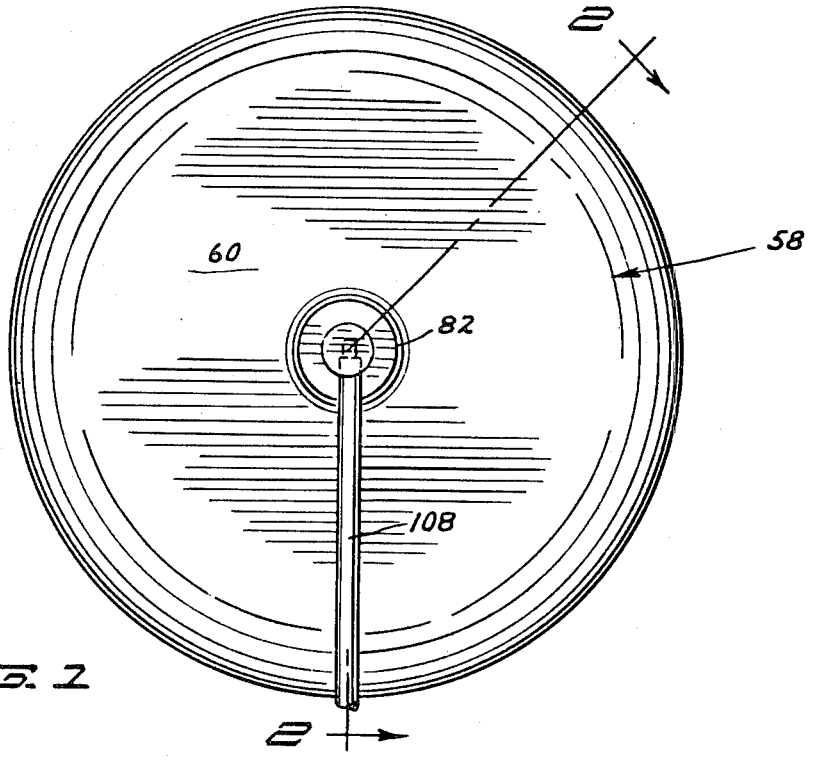
FIG. 2 is a sectional view on the line 2—2 of FIG. 1.
Figure 3:
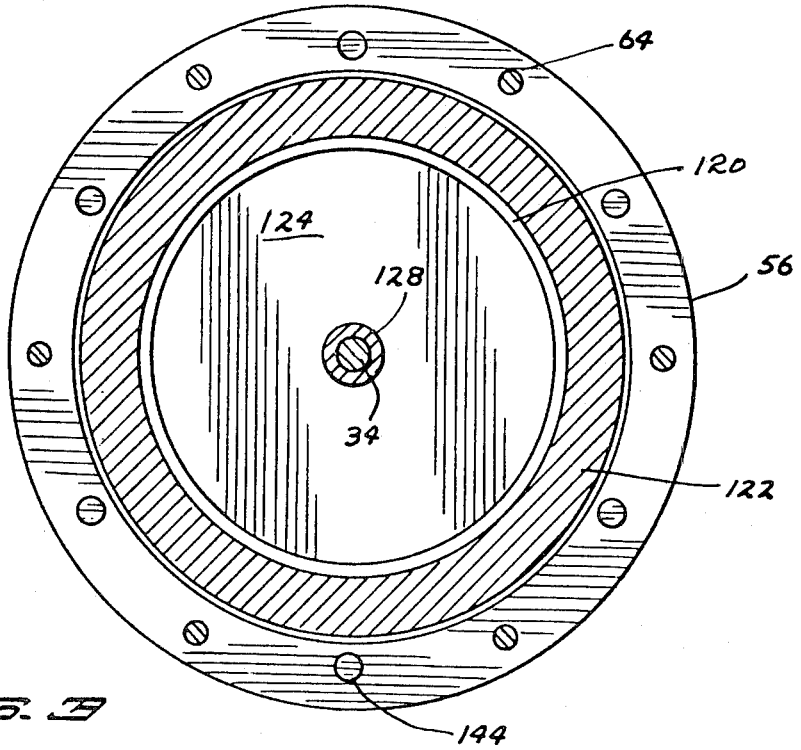
FIG. 3 is a sectional view on the line 3—3 of FIG. 2.
Figure 2:
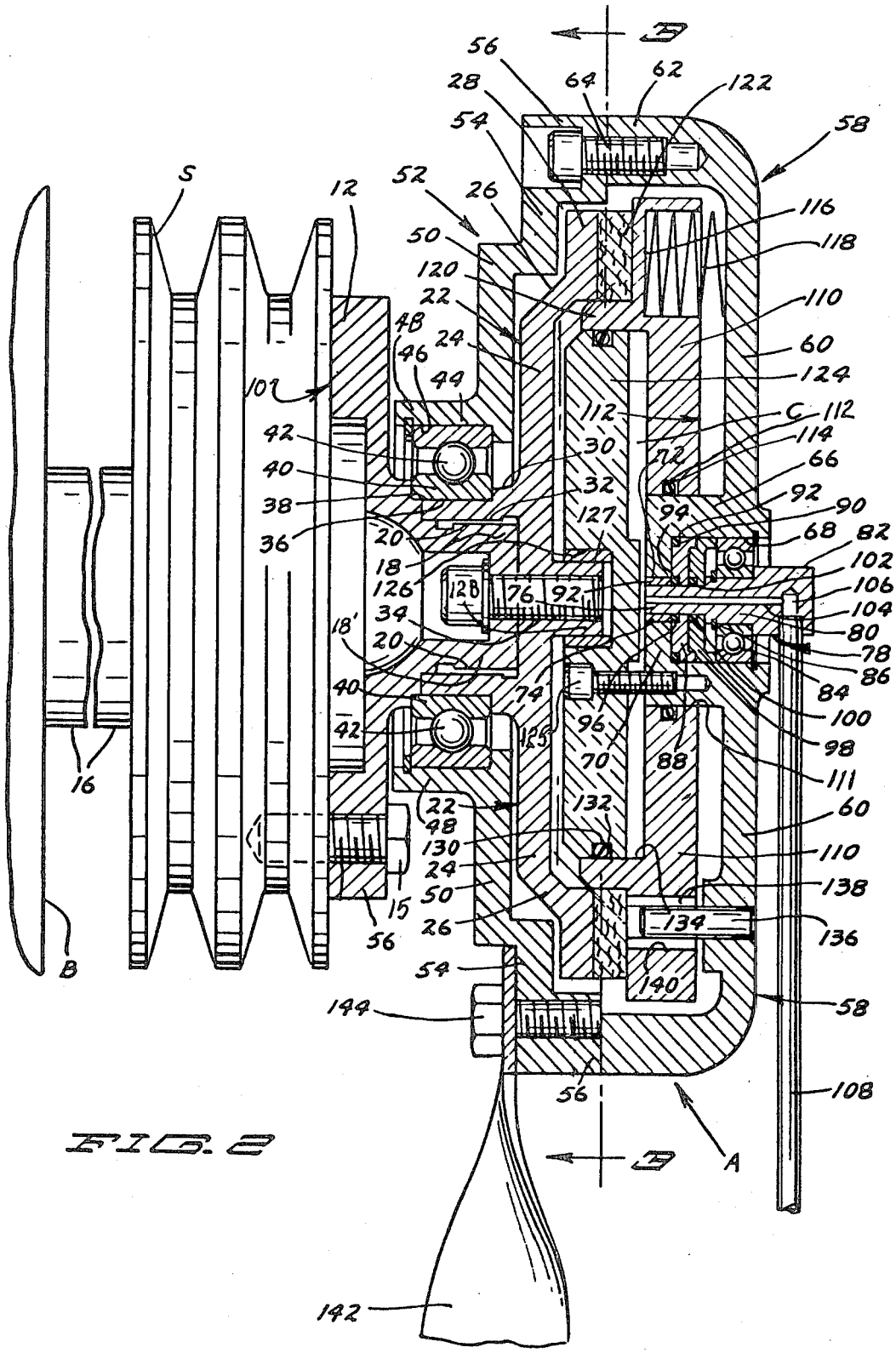

The remaining disclosure of the present invention, including preferred embodiments, is incorporated herein by reference to application Ser. No. 180,846 filed Aug. 25, 1980 by Hugh K. Schilling entitled "Spring Engaged Fluid Released Fan Clutch For a Live Shaft", now U.S. Pat. No. 4,355,710, the parent application of the present application.

Having thus described the invention, what is claimed as new and desired to be secured by Letters Patent is:

1. Apparatus for rotatably relating a first member and a second member comprising, in combination: means for rotatably mounting the first member with respect to the second member, with the first member including a friction disc; a disc-like cylinder plate having a perimeter; means for connecting the cylinder plate to the second member; means for rotatably mounting the cylinder plate to the friction disc of the first member; an annular piston having an axial hole, with the axial hole of the annular piston being slideably mounted on the connecting means, with the piston being reciprocal between the second member and the disc-like cylinder plate, with a piston chamber being defined between the disc-like cylinder plate and the annular piston; friction facing operatively attached to the piston for engagement contact with the friction disc for rotatably relating the first and second members; means for introducing air pressure into the piston chamber for separating the disc-like cylinder plate and the annular piston; and means for biasing the annular piston towards the disc-like cylinder plate.

2. The apparatus of claim 1 wherein the disc-like cylinder plate is rotatably mounted to the friction disc of the first member by a stub extending from the friction disc and rotatably received within a recess formed in the disc-like cylinder plate.

3. The apparatus of claim 1 wherein the annular piston includes a radially extending annular body portion and an axially extending annular flange having a shape complementary to and for sliding receipt on the perimeter of the disc-like cylinder plate, and wherein the piston chamber is defined by the disc-like cylinder plate and the annular body portion and annular flange of the annular piston.

4. The apparatus of claim 1 wherein the second member comprises, in combination: a first outer shell portion and a second outer shell portion connected together, with the means for rotatably mounting the first member with respect to the second member comprising means for rotatably mounting the second member on the first member including bearing means between the first outer shell portion of the second member and the first member.

5. The apparatus of claim 1 wherein the first member includes a live shaft means and wherein the apparatus acts as a clutch to drive the second member.

6. The apparatus of claim 5 wherein the means for rotatably mounting the first member with respect to the second member comprises means for rotatably mounting the second member for sole support by and on the first member.

7. The apparatus of claim 5 further comprising fan blades operatively attached to the second member.

8. The apparatus of claim 7 wherein the second member comprises a first shell portion, with the means for rotatably mounting the first member with respect to the second member comprising means for rotatably mounting the second member on the first member including bearing means between the first outer shell portion of the second member and the first member, with the first shell portion extending generally radially from the bearing means, with the fan blades being connected to the first shell portion wherein the fan load is substantially centered over the bearing means.

9. The apparatus of claim 8 wherein the second member further comprises a second shell portion including a central, generally flat body portion and an annular flange extending from the outer periphery of the body portion of the second shell portion; and means for removably securing the annular flange of the second shell portion to the first shell portion.

10. The apparatus of claim 4 or 9 wherein the connecting means comprises, in combination: a hub formed on the second outer shell portion; with the axial hole of the annular piston having a size and shape for slideable receipt on the hub of the second outer shell portion.

11. The apparatus of claim 10 wherein the air pressure introducing means comprises, in combination: a rotary air union rotatably received within an axial recess formed in the hub of the second outer shell portion, with the rotary air union being in fluid communication with a source of fluid and the piston chamber.

12. The apparatus of claim 10 wherein the disc-like cylinder plate is rotatably related to the second member by bolts which extend between the disc-like cylinder plate and the hub of the second outer shell portion.

13. The apparatus of claim 12 wherein the disc-like cylinder plate is rotatably mounted to the friction disc of the first member by a stub extending from the friction disc and rotatably received within a recess formed in the disc-like cylinder plate.

14. The apparatus of claim 9 wherein the annular piston is reciprocal between the generally flat body portion of the second member and the disc-like cylinder plate.

* * * * *